United States Patent [19]

Kim

[11] Patent Number: 4,751,954

[45] Date of Patent: Jun. 21, 1988

[54] METHOD OF CASTING BIMETALLIC ARTICLES

[76] Inventor: Jae H. Kim, 343-1 Bookgajah-2-Dong, #Yunlip 4-5, Sudaemoon-Ku, Seoul, Rep. of Korea

[21] Appl. No.: 77,248

[22] Filed: Jul. 24, 1987

[30] Foreign Application Priority Data

Aug. 29, 1985 [KR] Rep. of Korea ..... 85-6577

[51] Int. Cl.[4] ..... B22D 19/00; B22D 19/16; B22D 25/02

[52] U.S. Cl. ..... 164/9; 164/35; 164/98

[58] Field of Search ..... 164/9, 10, 35, 36, 98

[56] References Cited

U.S. PATENT DOCUMENTS

| | | | |
|---|---|---|---|
| 3,731,726 | 5/1973 | Eberle | 164/9 X |
| 4,243,093 | 1/1981 | Nieman | 164/9 X |
| 4,246,954 | 1/1981 | Cohen et al. | 164/35 |

*Primary Examiner*—Nicholas P. Godici
*Assistant Examiner*—J. Reed Batten, Jr.
*Attorney, Agent, or Firm*—Birch, Stewart, Kolasch & Birch

[57] ABSTRACT

A method for selectively coating inexpensive accessories with expensive multi-metals sequentially by utilizing an apparatus of a cylinder member, standing member, wax rod, and glass housing for producing fine products which are coated with colorful expensive multi-metals.

9 Claims, 1 Drawing Sheet

FIG. 1
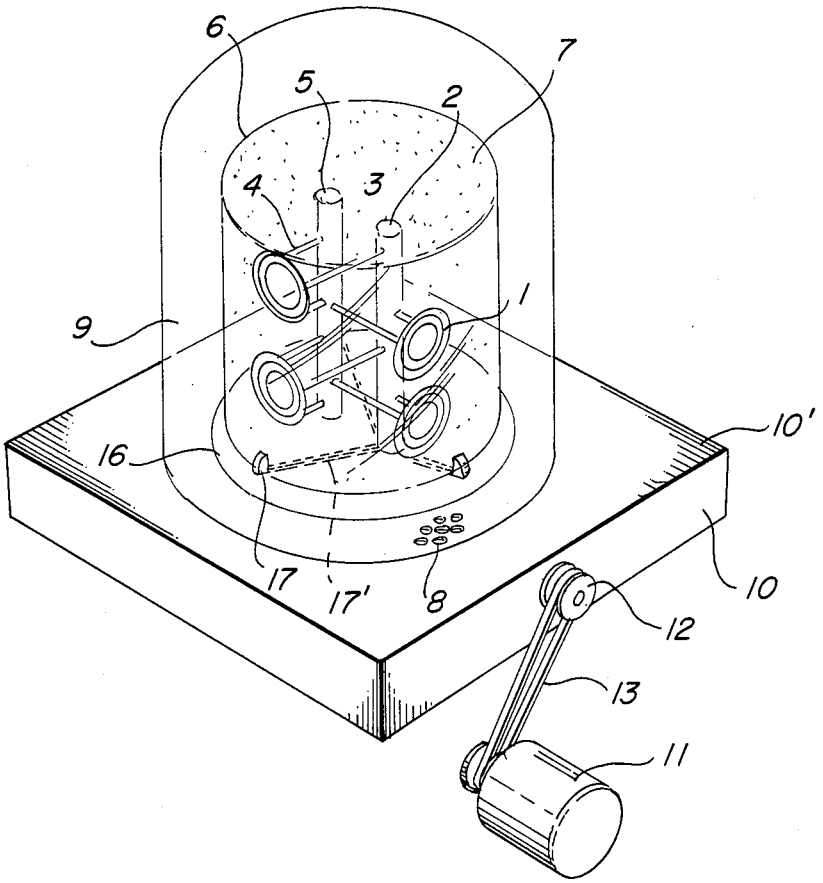
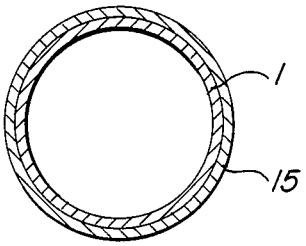
FIG. 2
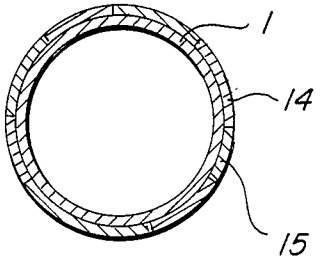
FIG. 3

METHOD OF CASTING BIMETALLIC ARTICLES

BACKGROUND OF THE INVENTION

The present invention relates to a method and apparatus for double casting to coat accessories with multi-metals and more particularly, to a method for selectively and sequentially coating an inexpensive copper alloy ring with expensive coating materials such as silver, gold and the like. Also, the present invention relates to a method for coating inexpensive material accessories with expensive coating materials utilizing an apparatus thereof.

There are many types of known multi-metal coating methods which utilize a press method on a plate. However, such methods cannot coat a ring-type accessory. Also, manual coating methods are frequently used, however, these methods require time, experience, man power, etc. thus, it is difficult to mass produce such fine products.

OBJECTS AND SUMMARY OF THE INVENTION

Accordingly, it is an object of the present invention to provide a method for coating inexpensive material accessories with expensive coating materials.

It is another object of the present invention to provide an improved method for selectively coating an inexpensive accessory frame with an expensive metal such as silver, gold and the like.

It is a further object of the present invention to provide an improved method for coating accessories utilizing an apparatus which comprises a cylinder member, a wax rod means connected to the accessory to be coated for introducing expensive metals through a conduit which is formed by melting out the wax of the wax rod means, and a vacuum system for actuating a vacuum condition in the cylinder member after introducing the investment material into the cylinder member.

Other objects and further scope of applicability of the present invention will become apparent from the detailed description given hereinafter. It should be understood, however, that the detailed description and specific examples, which indicating preferred embodiments of the invention, are given by way of illustration only, since various changes and modifications within the spirit and scope of the invention will become apparent to those skilled in the art from this detailed description.

The present invention relates to a method for selectively coating inexpensive accessories with expensive multi-metals sequentially utilizing as an apparatus, a cylinder member including a vacuum system for producing fine products which are coated with colorful expensive multi-metals.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of the apparatus for coating accessories according to the present invention;

FIG. 2 is a cross-sectional view of a ring accessory coated with one metal according to the method and apparatus of the present invention; and FIG. 3 is a cross-sectional view of a ring accessory coated with multi-metal according to the method and apparatus of the present invention.

DETAILED DESCRIPTION OF THE INVENTION

Referring now in detail to the drawings for the purpose of illustrating the present invention, the coating apparatus as shown in FIG. 1 comprises a cylinder member 6 supported on a base plate 10, a metal standingmember 2 on which is mounted a plurality of ring accessories 1, a wax rod 5 which is eventually melted to produce a conduit for introducing metals therethrough to the surface of the plurality of ring accessories 1, and a glass housing 9 for covering the cylinder member 6. The top end of the metal standing member 2 and the wax rod 5 are located below the top of the cylinder member 6, respectively.

The cylinder member 6 contains the metal standing member 2 and the wax rod 5 which connect together with the plurality of accessories 1 disposed therein. A plurality of apertures 8 are disposed on the base plate 10 between the cylinder member 6 and hosuing 9 for exhausting the air from the cylinder member after the investment material 7 is introduced into the cylinder member 6. The plurality of apertures 8 communicate with a vacuum pump 12 which connects to a motor 11 through a belt 13.

The base plate 10 is provided with a rubber plate 10' disposed thereon for tightly securing the glass housing 9 and the cylinder member 6 thereon. A rubber cover 16 extends beyond the base of the cylinder member 6 and is disposed on the rubber plate 10' of the base plate 10 for preventing the investment material 7 from leaking from the cylinder member 6. A plurality of locking members 17 are attached to the rubber cover 16 for fixing the cylinder member 6 to the rubber plate 10'. The metal standing member 2 is based on the cross portion of foundation members 17' of which ends connect to the locking members 17.

According to a preferred embodiment of the present invention, there is produced an accessory such as a copper alloy ring 1 which has selective coatings of gold and silver disposed on the surface thereof as shown in FIG. 3. Also, a copper alloy ring 1 has a coating of gold disposed on the surface thereof as shown in FIG. 2.

Initially, predetermined inexpensive copper alloy rings 1 made of nickel, copper, zinc, and the like, which are coated with a wax in the areas to be later coated with the expensive metal, such as gold 15 are attached to the metal standing member 2 through a metal supporting member 3. The metal standing member 2 and supporting member 3 are provided only for the purpose of supporting the alloy rings 1 within the cylinder member 6. Thus, selected portions of the copper alloy rings 1 are coated with a wax which is later removed so that said portions can be coated with gold and/or silver sequentially. Only the coated wax portions of the rings 1 communicate with the wax rod 5 through a plurality of wax branch rods 4. The cylinder member 6 is then filled with the investment material 7 which surrounds the wax rod 5, the wax branch rods 4 and coats the waxed portions of the rings as well as the unwaxed portions thereof. When the entire composite is then heated in a heating furnace, all of the wax melts out. Spaces are thus created where the wax was located in the solid investment material 7 in the cylinder member 6. Thus, the space defines a main channel which communicates through branch channels to selected locations in the ring 1 where the wax was previously located. Gold is then introduced in the form of a melt into the bottom of the main channel, through branch channel to coat the selected surfaces of the ring 1.

The glass housing 9 surrounds the cylinder member 6, whereby the cylinder member 6 can be placed in a vacuum condition by operating the vacuum pump 12 through the motor 11. Thus, the air in the cylinder member 6 is exhausted from the cylinder member 6 through the plurality of air outlet apertures 8 to the atmosphere. After switching off and removing the belt 13 from the vacuum pump 12, the housing 9 is separated from the molded investment material 7 and the molded investment 7 is heated in an electric furnace to melt the wax and harden the investment material as discussed above. After the gold is introduced to the specific areas on the ring and solidified, the investment material 7 is broken away from the entire system, leaving rings having specific portions which are coated with gold. Now the procedure is repeated to apply second metal to the rings 1. Thus, the remaining surface portions of the rings 1 are coated with wax. The portions fo the rings 1 which are coated with wax are now attached to the metal supporting member 3 and to new wax branch rods 4 which connect to a new wax rod 5. After the investment material 7 is introduced into the cylinder member 6, the molded investment material 7 is heated in the electric furnace and the second metal, which must have a lower melting point than that of the original metal, for example, silver 14 is introduced through the channel through the branch channels to the new areas on the rings 1 from which the wax has been previously removed. Prior to heating the cylinder 6 is evacuated to remove impurities from the system. Accordingly, the silver 14 can then be coated thereon (FIG. 3). Thus, sections of the inexpensive alloy rings 1 are first coated with expensive gold 15 (FIG. 2) and the silver 14 is coated on the remaining sections for producing a fine accessory having a good appearance.

Also, third or fourth metals can be coated on the same accessory ring in the same manner.

The particular coating metals can be selected as desired, with a proviso that the metals are applied using the highest melting point first and the lowest melting point last. Also, the method and apparatus of the present invention can be applied to any type of jewelry accessory or the like industry.

The investment material is a white powder to which water is added to make a molding paste. Upon the application of heat, the molding paste hardens into a rigid structure. It is non-toxic, non-corrosive and is manufactured by Ransom and Randolph.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A method for coating accessories with multi-metals which comprises the steps of:

(a) mounting an inexpensive accessory frame to a metal standing member supported on a base plate, (b) mounting a wax rod to said base plate, adjacent said metal standing member, (c) providing a wax coating on a desired portion of the accessory frame to be coated with an expensive metal, (d) providing a wax connecting rod between said wax portion on the accessory frame and the wax rod, (e) enveloping all of the members defined by steps (a) to (d) with an investment material to form a composite, (f) heating the composite to harden the investment material and melt the wax to leave channels in place of the wax, (g) introducing molten expensive metal through the channels created by the melting of the wax to coat the desired portion of the accessory frame, and (h) removing the investment material from around the accessory frame to produce an expensive metal coated product.

2. The method of claim 1 wherein the inexpensive accessory frame is made of nickel-copper-zinc alloy.

3. The method of claim 1 wherein the expensive metal is gold.

4. The method of claim 1 wherein the expensive metal is silver.

5. A method for coating accessories with multi-metals which comprises the steps of:

(a) mounting an inexpensive accessory frame to a metal standing member supported on a base plate, (b) mounting a wax rod to said base plate, adjacent said metal standing member, (c) providing a wax coating on at least one selective surface portion of the accessory frame to be coated with a first expensive metal, (d) providing a wax connecting rod between said wax portion on the accessory frame and the wax rod, (e) enveloping all of the members defined by steps (a) to (d) with an investment material to form a composite, (f) heating the composite to harden the investment material and melt the wax to leave channels in place of the wax, (g) introducing molten first expensive metal through the channels created by the melting of the wax to coat the at least one selective surface of the accessory frame.

(h) removing the investment material from around the accessory frame to produce a first expensive metal coated product, (i) mounting the inexpensive accessory frame coated with said first expensive metal to a metal standing member supported on a base plate, (j) mounting a wax rod to said base plate, adjacent said metal standing member, (k) providing a wax coating on desired surface portions of the accessory frame to be coated with a second expensive metal, (l) providing a wax connecting rod between said wax portion on the accessory frame and the wax rod, (m) enveloping all of the members defined by steps (i) to (l) with an investment material to form a composite, (n) heating the composite to harden the investment material and melt the wax to leave channels in place of the wax, (o) introducing molten second metal through the channels created by the melting of the wax to coat the desired surface portions of the accessory frame, and (p) removing the investment material from around the accessory frame to produce a first and second expensive metal coated product.

6. The method of claim 5 wherein the inexpensive accessory frame is made of nickel-copper-zinc alloy.

7. The method of claim 5 wherein the first expensive metal is gold.

8. The method of claim 5 wherein the second expensive metal is silver.

9. The method of claim 5 wherein the first expensive metal must have higher melting point than that of the second expensive metal.

* * * * *